US011691192B2

(12) United States Patent
Nogiwa et al.

(10) Patent No.: US 11,691,192 B2
(45) Date of Patent: Jul. 4, 2023

(54) FORMING SYSTEM

(71) Applicant: SUMITOMO HEAVY INDUSTRIES, LTD., Tokyo (JP)

(72) Inventors: Kimihiro Nogiwa, Ehime (JP); Masayuki Ishizuka, Ehime (JP); Masayuki Saika, Ehime (JP); Norieda Ueno, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 14 days.

(21) Appl. No.: 16/540,664

(22) Filed: Aug. 14, 2019

(65) Prior Publication Data

US 2019/0366410 A1 Dec. 5, 2019

Related U.S. Application Data

(63) Continuation of application No. PCT/JP2018/005556, filed on Feb. 16, 2018.

(30) Foreign Application Priority Data

Mar. 21, 2017 (JP) ..... JP2017-054897

(51) Int. Cl.
*B21D 26/033* (2011.01)
*B21D 39/02* (2006.01)
(Continued)

(52) U.S. Cl.
CPC ..... *B21D 26/033* (2013.01); *B21D 39/02* (2013.01); *B21D 43/003* (2013.01); *B21D 43/006* (2013.01)

(58) Field of Classification Search
CPC .... B21D 26/033; B21D 39/02; B21D 43/003; B21D 26/053; B21D 43/00; B21D 26/039;
(Continued)

(56) References Cited

U.S. PATENT DOCUMENTS 3,970,910 A * 7/1976 Schindler ..... G05D 3/14 318/576
6,322,645 B1 11/2001 Dykstra et al.
(Continued)

FOREIGN PATENT DOCUMENTS

CA 2954857 A1 1/2016
EP 0 588 528 A1 3/1994
(Continued)

OTHER PUBLICATIONS

English translate (JPS5893519A), retrieved date Apr. 19, 2022.*
(Continued)

*Primary Examiner* — Matthew Katcoff
*Assistant Examiner* — Mohammed S. Alawadi
(74) *Attorney, Agent, or Firm* — Michael Best & Friedrich LLP

(57) ABSTRACT

A forming system includes: a forming apparatus which supplies gas into a cylindrical metal pipe material having a welded portion to expand the metal pipe material; a supply device for supplying the metal pipe material to the forming apparatus; and a control device for controlling an operation of the supply device, in which in a case where a position where a distance from a center of the metal pipe material is the longest, on a surface of the die, when viewed from an extension direction of the metal pipe material in a state where the metal pipe material is disposed between the dies, is a longest position, the control device includes a control unit which controls supply of the metal pipe material to the forming apparatus such that the welded portion is not located on a straight line connecting the longest position and the center of the metal pipe material.

14 Claims, 12 Drawing Sheets

(51) Int. Cl.
*B21D 43/00* (2006.01)
*B21D 26/053* (2011.01)
*B21D 43/02* (2006.01)

(58) Field of Classification Search
CPC ... B21D 26/041; B21D 26/043; B21D 26/045
USPC ..... 72/58, 61; 29/421.1
See application file for complete search history.

(56) References Cited

U.S. PATENT DOCUMENTS

| | | | | |
|---|---|---|---|---|
| 7,249,481 | B1 | 7/2007 | Lowe | |
| 7,661,283 | B2 * | 2/2010 | Hori | B21C 37/155 72/58 |
| 2015/0360281 | A1 | 12/2015 | May et al. | |

FOREIGN PATENT DOCUMENTS

| | | | | |
|---|---|---|---|---|
| JP | S57-19114 | A | | 2/1982 |
| JP | S58-093519 | A | | 6/1983 |
| JP | S5893519 | A | * | 6/1983 |
| JP | S59-101223 | A | | 6/1984 |
| JP | S61-17323 | A | | 1/1986 |
| JP | 2004-276096 | A | | 10/2004 |
| JP | 2004-283897 | A | | 10/2004 |
| JP | 2006116547 | A | | 5/2006 |
| JP | 2012-000654 | A | | 1/2012 |
| JP | 2013-184600 | A | | 9/2013 |
| KR | 20080045046 | A | * | 5/2008 |
| KR | 20080045046 | A | * | 5/2008 |

OTHER PUBLICATIONS

English translate (KR20080045046A), retrieved date Apr. 19, 2022.*
Search Report issued in European Application No. 18772649.2—1016/3603838, dated Apr. 2, 2020.
International Search Report issued in Application No. PCT/JP2018/005556, dated Apr. 10, 2018.
Xie Wencai et al., "Thickness and Deformation Characters of Seamed Tube Hydroforming with Twisted Axis," Journal of Mechanical Engineering, DOI: 10.3901/JME.2016.22.078, vol. 52, No. 22, pp. 78-83, Nov. 2016.
Office Action for Chinese Patent Application No. 201880007907.7, dated Apr. 10, 2020.

* cited by examiner

FORMING SYSTEM

RELATED APPLICATIONS

The contents of Japanese Patent Application No. 2017-054897, and of International Patent Application No. PCT/JP2018/005556, on the basis of each of which priority benefits are claimed in an accompanying application data sheet, are in their entirety incorporated herein by reference.

BACKGROUND

Technical Field

Certain embodiments of the present invention relate to a forming system.

Description of Related Art

In the related art, there is known a forming system for forming a metal pipe from a cylindrical metal pipe material having a welded portion in which end portions of a plate material are welded to each other. As such a forming system, for example, the related art discloses a forming system which includes a forming apparatus having a set of dies and a heating and expanding part which heats a metal pipe material disposed between the set of dies and supplies a gas into the metal pipe material to expand the metal pipe material.

SUMMARY

According to an embodiment of the present invention, there is provided a forming system including: a forming apparatus which supplies a gas into a cylindrical metal pipe material having a welded portion in which end portions of a plate material are welded to each other, in a state where the metal pipe material is disposed between a set of dies, thereby expanding the metal pipe material; a supply device which supplies the metal pipe material to the forming apparatus; and a control device which controls an operation of the supply device, in which, in a case where a position at which a distance from a center of the metal pipe material is the longest, on a surface of the die, in a case of being viewed from an extension direction of the metal pipe material in a state where the metal pipe material is disposed between the set of dies, is set to be a longest position, the control device includes a control unit which controls supply of the metal pipe material to the forming apparatus by the supply device such that the welded portion is not located on a straight line connecting the longest position and the center of the metal pipe material.

According to another embodiment of the present invention, there is provided a forming system including: a forming apparatus which supplies a gas into a cylindrical metal pipe material having a welded portion in which end portions of a plate material are welded to each other, in a state where the metal pipe material is disposed between a set of dies, thereby expanding the metal pipe material; a supply device which supplies the metal pipe material to the forming apparatus; and a control device which controls an operation of the supply device, in which, in a case where a position at which a distance from a center of the metal pipe material is the shortest, on a surface of the die, in a case of being viewed from an extension direction of the metal pipe material in a state where the metal pipe material is disposed between the set of dies, is set to be a shortest position, the control device includes a control unit which controls supply of the metal pipe material to the forming apparatus by the supply device such that the welded portion is located on a straight line connecting the shortest position and the center of the metal pipe material.

BRIEF DESCRIPTION OF THE DRAWINGS

FIGS. 5A to 5C are enlarged views of the surroundings of an electrode, in which FIG. 5A is a diagram showing a state where the electrode holds the metal pipe material, FIG. 5B is a diagram showing a state where a seal member is pressed against the electrode, and FIG. 5C is a front view of the electrode.

DETAILED DESCRIPTION

Figure 1:
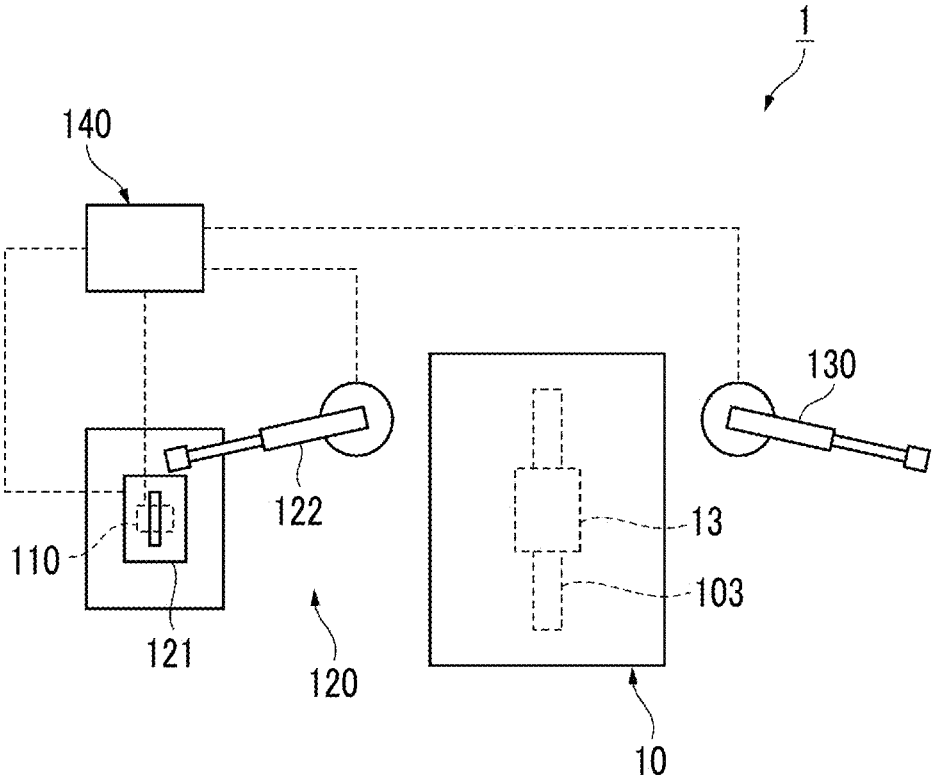
FIG. 1 is a schematic configuration diagram showing a forming system of one embodiment.

In the forming system of the related art described above, when the metal pipe material expands, a plate thickness of the metal pipe material becomes thin according to a pipe expansion rate of the metal pipe material. Here, the smaller the deformation resistance of the metal pipe material, the larger the pipe expansion rate of the metal pipe material is, and thus the plate thickness becomes thinner.

Incidentally, there is a case where the metal pipe material is made into a pipe shape by rounding a metal plate material and welding a connection portion. In a case where a metal pipe material having such a welded portion is used, if the metal pipe material is heated, the deformation resistance of the welded portion tends to be reduced compared to the plate material portion. For this reason, in the forming system of the related art described above, if an attempt to heat the metal pipe material and supply a gas into the metal pipe material to expand it is made, the plate thickness of the welded portion of the metal pipe material heated to a high temperature becomes particularly thin locally, and thus there is a concern that the metal pipe material may be damaged starting from the welded portion.

Therefore, it is desirable to provide a forming system in which it is possible to suppress breakage of a metal pipe material starting from a welded portion at the time of forming of a metal pipe.

In the forming system according to an aspect of the present invention, when the heated metal pipe material expands, the welded portion of the metal pipe material comes into contact with the surface of the die prior to the portion which is located on the straight line connecting the longest position and the center of the metal pipe material. Here, if the heated metal pipe material expands and comes into contact with the surface of the die, the portion which is in contact with the die is cooled due to heat conduction, and thus the deformation resistance of the portion increases. Therefore, in this forming system, at the time of the forming of the metal pipe, the welded portion comes into contact with the die at an early timing, and thus the deformation resistance of the welded portion increases at an early timing, and therefore, it is possible to suppress the plate thickness of the welded portion becoming particularly thin locally. Accordingly, it is possible to suppress the breakage of the metal pipe material starting from the welded portion at the time of the forming of the metal pipe.

In the forming system according to another aspect of the present invention, when the heated metal pipe material expands, the welded portion of the metal pipe material, which is located on the straight line connecting the shortest position and the center of the metal pipe material, first comes into contact with the surface of the die. Here, if the heated metal pipe material expands and comes into contact with the surface of the die, the portion which is in contact with the die is cooled due to heat conduction, and thus the deformation resistance of the portion increases. Therefore, in this forming system, at the time of the forming of the metal pipe, the welded portion first comes into contact with the die, and thus the deformation resistance of the welded portion first increases, and therefore, it is possible to suppress the plate thickness of the welded portion becoming particularly thin locally. Accordingly, it is possible to particularly suppress the breakage of the metal pipe material starting from the welded portion at the time of the forming of the metal pipe.

In the forming system according to an aspect of the present invention, the control device may include a storage unit which stores the longest position, and the control unit may control the supply of the metal pipe material to the forming apparatus by the supply device such that the welded portion is not located on the straight line, based on information on the longest position stored in the storage unit.

In the forming system according to another aspect of the present invention, the control device may include a storage unit which stores the shortest position, and the control unit may control the supply of the metal pipe material to the forming apparatus by the supply device such that the welded portion is located on the straight line, based on information on the shortest position stored in the storage unit.

In the forming system according to each aspect of the present invention, the supply device may include a rotating part capable of rotating the metal pipe material around a central axis, and a transport part capable of gripping the metal pipe material and capable of transporting the gripped metal pipe material to the forming apparatus, and the control unit may control an operation of the rotating part so as to adjust a direction in which the welded portion is located with respect to the center of the metal pipe material in a case of being viewed from the extension direction, by rotating the metal pipe material around the central axis by the rotating part, when the metal pipe material is supplied to the forming apparatus by the supply device, and control an operation of the transport part so as to grip and transport the metal pipe material to the forming apparatus by the transport part. In this case, it is possible to adjust the direction in which the welded portion is located with respect to the center of the metal pipe material by the rotating part, and to transport the metal pipe material to the forming apparatus by the transport part. Accordingly, the operation and effects described above can be suitably exhibited.

In the forming system according to each aspect of the present invention, the supply device may include a rotation and transport part composed of an articulated arm capable of gripping the metal pipe material and rotating the gripped metal pipe material around a central axis and capable of transporting the metal pipe material to the forming apparatus, and the control unit may control an operation of the rotation and transport part so as to adjust a direction in which the welded portion is located with respect to the center of the metal pipe material in a case of being viewed from the extension direction, by gripping the metal pipe material and rotating the metal pipe material around the central axis by the rotation and transport part, and to transport the metal pipe material to the forming apparatus, when the metal pipe material is supplied to the forming apparatus by the supply device. In this case, it is possible to transport the metal pipe material to the forming apparatus while adjusting the direction in which the welded portion is located with respect to the center of the metal pipe material by the rotation and transport part. Accordingly, it is possible to shorten the time required to supply the metal pipe material to the forming apparatus by the supply device.

In the forming system according to each aspect of the present invention, the forming system may further include a position detection unit which detects a direction in which the welded portion is located with respect to the center of the metal pipe material in a case of being viewed from the extension direction, before the metal pipe material is supplied to the forming apparatus by the supply device. In this case, the operation and effects described above can be suitably exhibited.

According to the present invention, it becomes possible to suppress the breakage of the metal pipe material starting from the welded portion at the time of the forming of the metal pipe.

Hereinafter, an embodiment of a forming apparatus according to the present invention will be described with reference to the drawings. In each drawing, identical or corresponding portions are denoted by the same reference numerals, and overlapping description will be omitted.

One Embodiment

Configuration of Forming System

Figure 2:
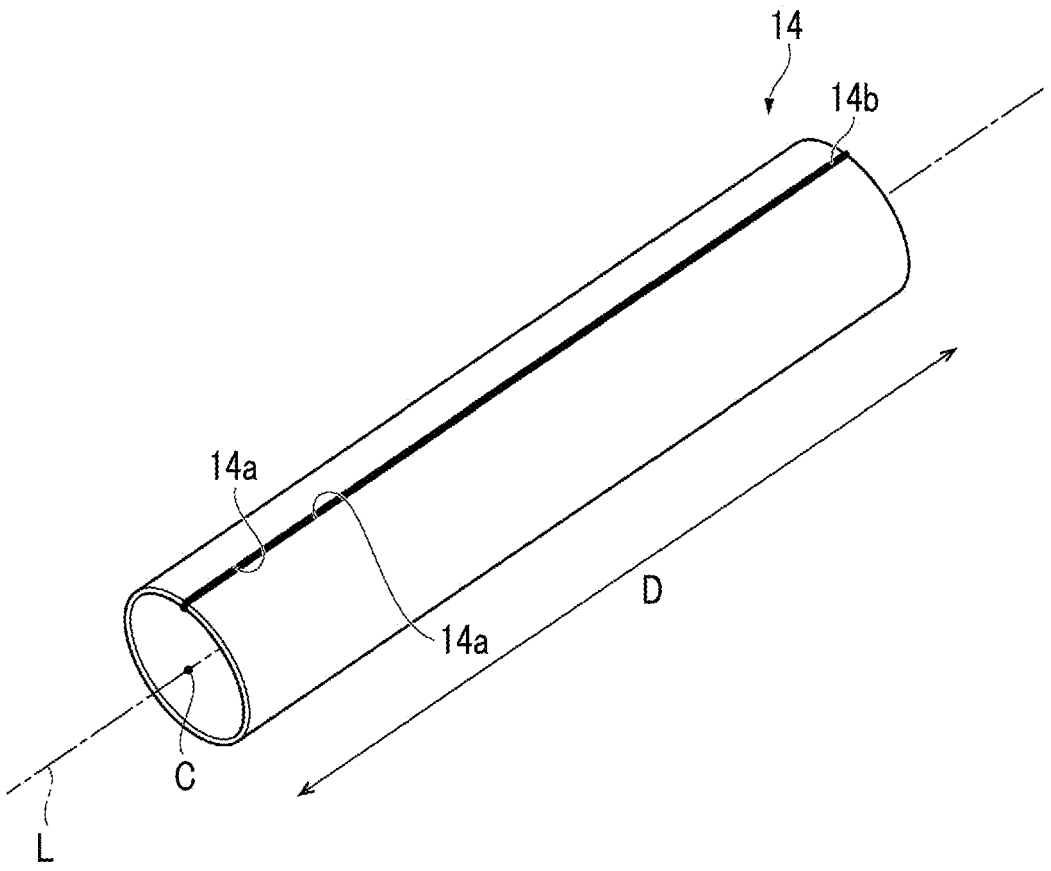
FIG. 2 is a perspective view showing an example of a metal pipe material.

FIG. 1 is a schematic configuration diagram showing a forming system of one embodiment, and FIG. 2 is a perspective view showing an example of a metal pipe material. A forming system 1 shown in FIG. 1 is for forming a metal pipe 90 (refer to FIG. 10) by using a cylindrical metal pipe material 14 having a welded portion 14*b* in which end portions 14*a* and 14*a* of a plate member are welded to each other, as shown in FIG. 2. More specifically, the metal pipe material 14 is formed by rounding a flat plate-like metal thin plate into a cylindrical shape and welding the facing end portions 14*a* and 14*a* in a state of being brought into contact with each other. The welded portion 14*b* where the metal pipe material 14 is welded in this manner extends along a central axis L of the metal pipe material 14. The central axis L of the metal pipe material 14 is parallel to an extension direction D of the metal pipe material 14. Then, as shown in FIG. 1, the forming system 1 includes a forming apparatus 10, a position detection unit 110, a supply device 120, an unloading device 130, and a control device 140.

Figure 3:
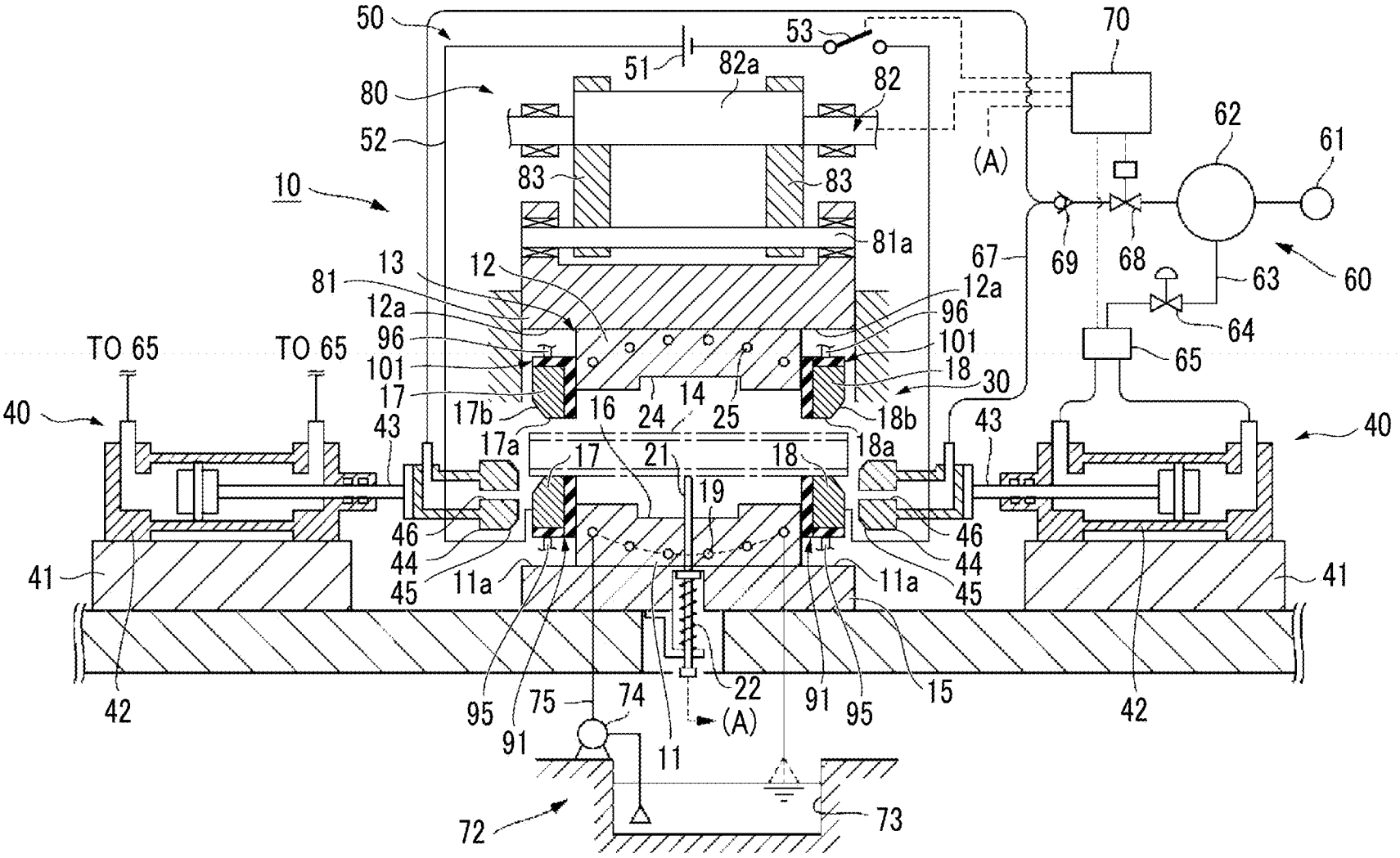
FIG. 3 is a schematic configuration diagram showing a forming apparatus in FIG. 1.
Figure 4:
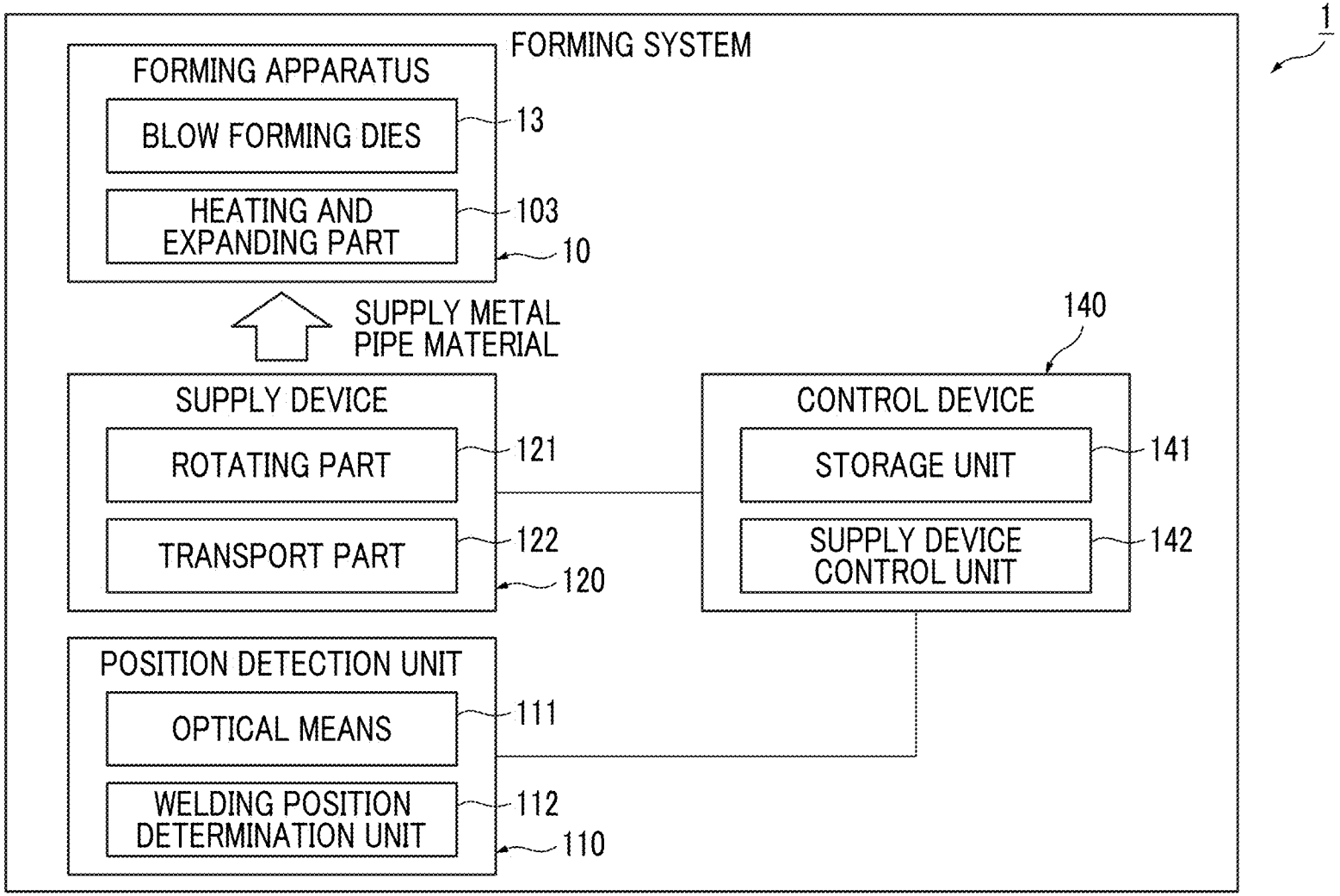
FIG. 4 is a functional block diagram showing the forming system of FIG. 1.

First, the configuration of the forming apparatus 10 will be described. FIG. 3 is a schematic configuration diagram showing the forming apparatus in FIG. 1, and FIG. 4 is a functional block diagram showing the forming system of FIG. 1. As shown in FIGS. 3 and 4, the forming apparatus 10 includes a set of blow forming dies (dies) 13 composed of an upper die 12 and a lower die 11, and a heating and expanding part 103 which heats the metal pipe material 14 disposed between the set of blow forming dies 13 and supplies a gas into the metal pipe material 14 to expand the metal pipe material 14.

The heating and expanding part 103 shown in FIG. 4 is configured to include a drive mechanism 80 which moves at least one of the upper die 12 and the lower die 11, a pipe holding mechanism 30 which holds the metal pipe material 14 between the upper die 12 and the lower die 11, a heating mechanism 50 which energizes and heats the metal pipe material 14 held by the pipe holding mechanism 30, a gas supply unit 60 for supplying a high-pressure gas (gas) into the metal pipe material 14 held and heated between the upper die 12 and the lower die 11, a pair of gas supply mechanisms 40 and 40 for supplying the gas from the gas supply unit 60 into the metal pipe material 14 held by the pipe holding mechanism 30, a water circulation mechanism 72 which forcibly water-cools the blow forming dies 13, and a forming apparatus control unit 70 which controls the drive of the drive mechanism 80, the drive of the pipe holding mechanism 30, the drive of the heating mechanism 50, and the gas supply of the gas supply unit 60, as shown in FIG. 3.

The lower die 11 which is one of the blow forming dies 13 is fixed to a base 15. The lower die 11 is formed of a large steel block and has a cavity (recessed portion) 16 having a desired shape on the upper surface thereof. A cooling water passage 19 is formed in the lower die 11, and the lower die 11 is provided with a thermocouple 21 inserted from below at substantially the center. The thermocouple 21 is supported by a spring 22 so as to be movable up and down. The cavity 16 is formed in a shape according to the shape (outer shape) of the metal pipe 90 to be formed (refer to FIG. 7).

Further, a space 11*a* is provided in the vicinity of each of the right and left ends (right and left ends in FIG. 1) of the lower die 11, and electrodes 17 and 18 (lower electrodes) (described later), which are movable parts of the pipe holding mechanism 30, and the like are disposed in the spaces 11*a* so as to be able to move up and down. Then, the metal pipe material 14 is placed on the lower electrodes 17 and 18, whereby the lower electrodes 17 and 18 come into contact with the metal pipe material 14 which is disposed between the upper die 12 and the lower die 11. In this way, the lower electrodes 17 and 18 are electrically connected to the metal pipe material 14.

Insulating materials 91 for preventing electric conduction are provided between the lower die 11 and the lower electrode 17, below the lower electrode 17, between the lower die 11 and the lower electrode 18, and below the lower electrode 18. Each of the insulating materials 91 is fixed to an advancing and retracting rod 95 which is a movable portion of an actuator (not shown) configuring the pipe holding mechanism 30. The actuator is for moving the lower electrodes 17 and 18 and the like up and down, and a fixed portion of the actuator is held on the base 15 side together with the lower die 11.

The upper die 12 which is the other die of the blow forming dies 13 is fixed to a slide 81 (described later) configuring the drive mechanism 80. The upper die 12 is formed of a large steel block and has a cooling water passage 25 formed in the interior thereof, and a cavity (recessed portion) 24 having a desired shape is provided on the lower surface of the upper die 12. The cavity 24 is provided at a position facing the cavity 16 of the lower die 11. The cavity 24 is formed in a shape according to the shape (outer shape) of the metal pipe 90 to be formed (refer to FIG. 7).

Similar to the lower die 11, a space 12*a* is provided in the vicinity of each of the right and left ends (right and left ends in FIG. 3) of the upper die 12, and electrodes 17 and 18 (upper electrodes) (described later), which are movable parts of the pipe holding mechanism 30, and the like are disposed in the spaces 12*a* so as to be movable up and down. Then, the upper electrodes 17 and 18 move downward in a state where the metal pipe material 14 is placed on the lower electrodes 17 and 18, whereby the upper electrodes 17 and 18 come into contact with the metal pipe material 14 disposed between the upper die 12 and the lower die 11. In this way, the upper electrodes 17, 18 are electrically connected to the metal pipe material 14.

Insulating materials 101 for preventing electric conduction are provided between the upper die 12 and the upper electrode 17, above the upper electrode 17, between the upper die 12 and the upper electrode 18, and above the upper electrode 18. Each of the insulating materials 101 is fixed to an advancing and retracting rod 96 which is a movable portion of the actuator configuring the pipe holding mechanism 30. The actuator is for moving the upper electrodes 17 and 18 and the like up and down, and a fixed portion of the actuator is held on the slide 81 side of the drive mechanism 80 together with the upper die 12.

A semicircular arc-shaped concave groove 18*a* corresponding to the outer peripheral surface of the metal pipe material 14 is formed in each of the surfaces of the electrodes 18 and 18, which face each other, in the right side portion of the pipe holding mechanism 30 (refer to FIGS. 5A to 5C), and the metal pipe material 14 can be placed so as to exactly fit to the portion of the concave groove 18*a*. Similar to the concave groove 18*a*, a semicircular arc-shaped concave groove corresponding to the outer peripheral surface of the metal pipe material 14 is formed in each of exposed surfaces of the insulating materials 91 and 101, which face each other, in the right side portion of the pipe holding mechanism 30. Further, a tapered concave surface 18*b* in which the periphery is recessed to be inclined in a tapered shape toward the concave groove 18*a* is formed on the front surface of the electrode 18 (the surface in an outer direction of the die). Accordingly, a configuration is made such that, if the metal pipe material 14 is clamped from an up-down direction at the right side portion of the pipe holding mechanism 30, the outer periphery of the right end portion of the metal pipe material 14 can be exactly surrounded so as to be in close contact over the entire circumference.

A semicircular arc-shaped concave groove 17*a* corresponding to the outer peripheral surface of the metal pipe material 14 is formed in each of the surfaces of the electrodes 17 and 17, which face each other, in the left side portion of the pipe holding mechanism 30 (refer to FIGS. 5A to 5C), and the metal pipe material 14 can be placed so as to exactly fit to the portion of the concave groove 17*a*. Similar to the concave groove 17*a*, a semicircular arc-shaped concave groove corresponding to the outer peripheral surface of the metal pipe material 14 is formed in each of exposed surfaces of the insulating materials 91 and 101, which face each other, in the left side portion of the pipe holding mechanism 30. Further, a tapered concave surface 17*b* in which the periphery is recessed to be inclined in a tapered shape toward the concave groove 17*a* is formed on the front surface of the electrode 17 (the surface in the outer direction of the die). Accordingly, a configuration is made such that, if the metal pipe material 14 is clamped from the up-down direction at the left side portion of the pipe holding mechanism 30, the outer periphery of the left end portion of the metal pipe material 14 can be exactly surrounded so as to be in close contact over the entire circumference.

As shown in FIG. 3, the drive mechanism 80 includes the slide 81 for moving the upper die 12 such that the upper die 12 and the lower die 11 are combined with each other, a shaft 82 for generating a driving force for moving the slide 81, and a connecting rod 83 for transmitting the driving force generated by the shaft 82 to the slide 81. The shaft 82 extends in a right-left direction above the slide 81, is rotatably supported, and has an eccentric crank 82*a* which protrudes and extends from the right and left ends at a position separated from the center thereof. The eccentric crank 82*a* and a rotary shaft 81*a* provided above the slide 81 and extending in the right-left direction are connected to each other by the connecting rod 83. In the drive mechanism 80, the height in the up-down direction of the eccentric crank 82*a* is changed by controlling the rotation of the shaft 82 by the forming apparatus control unit 70, and the up-and-down movement of the slide 81 can be controlled by transmitting the positional change of the eccentric crank 82*a* to the slide 81 through the connecting rod 83. Here, the oscillation (rotational movement) of the connecting rod 83, which occurs when the positional change of the eccentric crank 82*a* is transmitted to the slide 81, is absorbed by the rotary shaft 81*a*. The shaft 82 rotates or stops in response to the drive of a motor or the like, which is controlled by the forming apparatus control unit 70, for example.

The heating mechanism 50 includes a power source 51, a bus bar 52 extending from the power source 51, and a switch 53 provided in the bus bar 52. The bus bar 52 is connected to only the lower electrodes 17 and 18 and is a conductor for supplying the electric power from the power source 51 to the electrodes 17 and 18 connected thereto. The forming apparatus control unit 70 controls the heating mechanism 50 to heat the metal pipe material 14 to a quenching temperature (a temperature equal to or higher than an AC3 transformation temperature).

Figure 5A:
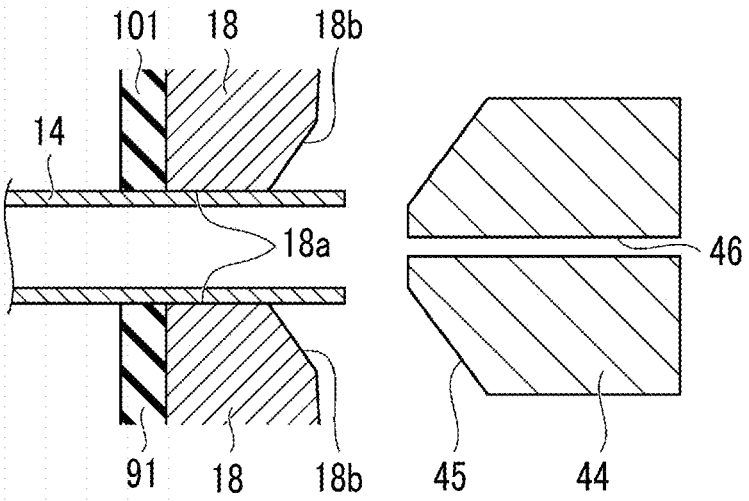
Figure 5B:
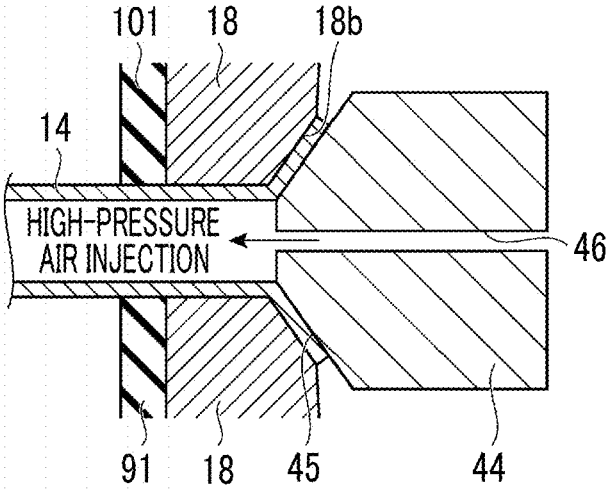
Figure 5C:
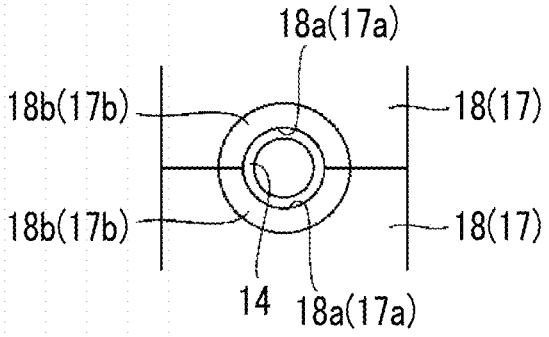

Each of the pair of gas supply mechanisms 40 includes a cylinder unit 42, a cylinder rod 43 which advances and retreats in accordance with the operation of the cylinder unit 42, and a seal member 44 connected to the tip of the cylinder rod 43 on the pipe holding mechanism 30 side. The cylinder unit 42 is placed on and fixed to a block 41. A tapered surface 45 which is tapered is formed on the tip of the seal member 44, and is configured in a shape which is fitted to the tapered concave surfaces 17*b* and 18*b* of the electrodes 17 and 18 (refer to FIGS. 5A and 5B). A gas passage 46 which extends from the cylinder unit 42 side toward the tip and through which the high-pressure gas supplied from the gas supply unit 60 flows, as shown in detail in FIGS. 5A and 5B, is provided in the seal member 44.

The gas supply unit 60 includes a gas source 61, an accumulator 62 for storing the gas supplied by the gas source 61, a first tube 63 extending from the accumulator 62 to the cylinder unit 42 of the gas supply mechanism 40, a pressure control valve 64 and a switching valve 65 provided in the first tube 63, a second tube 67 extending from the accumulator 62 to the gas passage 46 formed in the seal member 44, and a pressure control valve 68 and a check valve 69 provided in the second tube 67. The pressure control valve 64 plays a role of supplying a gas having an operating pressure adapted to a pressing force of the seal member 44 against the metal pipe material 14 to the cylinder unit 42. The check valve 69 plays a role of preventing the high-pressure gas from flowing backward in the second tube 67. The pressure control valve 68 provided in the second tube 67 plays a role of supplying a gas having an operating pressure for expanding the metal pipe material 14 to the gas passage 46 of the seal member 44 by the control of the forming apparatus control unit 70.

The forming apparatus control unit 70 can supply a gas having a desired operating pressure into the metal pipe material 14 by controlling the pressure control valve 68 of the gas supply unit 60. The forming apparatus control unit 70 may control the pressure control valve 68 of the gas supply unit 60 so as to be able to perform the supply (primary blow) of a high-pressure gas having a relatively low pressure and the supply (secondary blow) of a high-pressure gas having a relatively high pressure into the metal pipe material 14. Further, the forming apparatus control unit 70 acquires temperature information from the thermocouple 21 from information which is transmitted from (A) shown in FIG. 3, and controls the drive mechanism 80, the switch 53, and the like.

The water circulation mechanism 72 includes a water tank 73 for storing water, a water pump 74 for pumping up the water stored in the water tank 73, pressurizing it, and sending it to the cooling water passage 19 of the lower die 11 and the cooling water passage 25 of the upper die 12, and a pipe 75. Although omitted, a cooling tower for lowering a water temperature or a filter for purifying water may be provided in the pipe 75.

Figure 6:
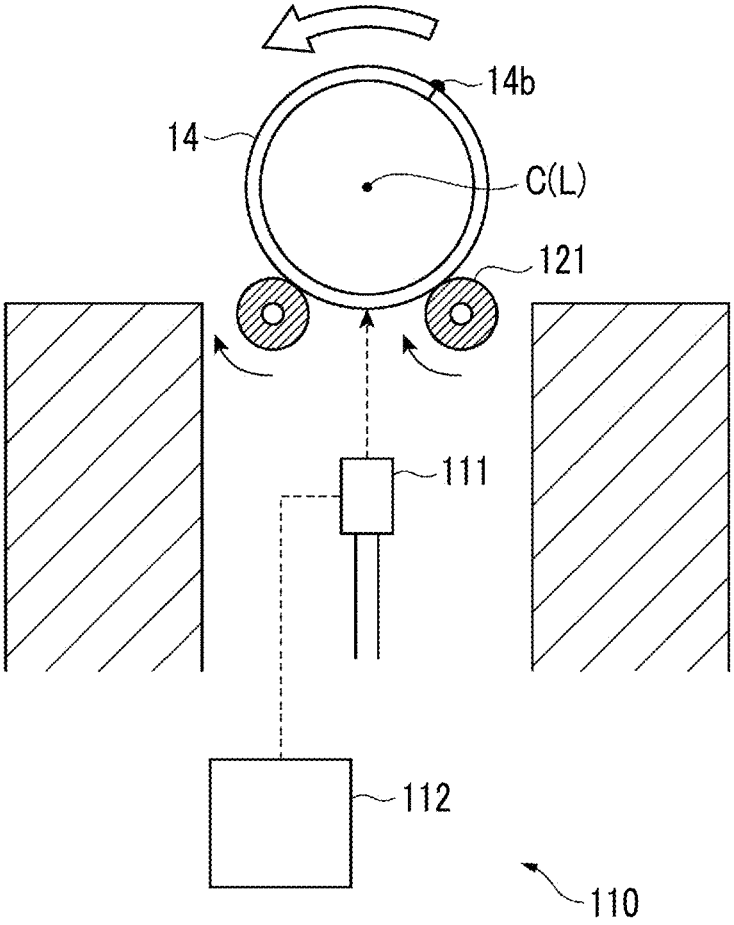
FIG. 6 is schematic configuration diagram showing a position detection unit and a rotating part in FIG. 1.

Next, the configuration of the position detection unit 110 shown in FIGS. 1 and 4 will be described. The position detection unit 110 detects the direction in which the welded portion 14*b* is located with respect to a center C of the metal pipe material 14 in a case of being viewed from the extension direction D of the metal pipe material 14, before the metal pipe material 14 is supplied to the forming apparatus 10 by the supply device 120 (described later). As shown in FIGS. 4 and 6, the position detection unit 110 includes optical means 111 and a welding position determination unit 112.

The optical means 111 is, for example, an optical camera, and photographs the outer peripheral surface of the metal pipe material 14 to acquire imaging data. The metal pipe material 14 is rotated around the central axis L by a rotating part 121 of the supply device 120 (described later) while the metal pipe material 14 is being photographed by the optical means 111. In this way, the optical means 111 can perform photographing over the entire circumference of the outer peripheral surface of the metal pipe material 14. The optical means 111 outputs the acquired imaging data to the welding position determination unit 112. The welding position determination unit 112 performs image processing on the imaging data input from the optical means 111, thereby detecting the position of the welded portion 14*b* on the outer peripheral surface of the metal pipe material 14. By the above, the welding position determination unit 112 detects the direction in which the welded portion 14*b* is located with respect to the center C of the metal pipe material 14.

The position detection unit 110 is not limited to such a configuration, and a known configuration can be applied thereto. For example, the optical means 111 may be configured to acquire imaging data by photographing the outer peripheral surface of the metal pipe material 14 by using a laser, instead of the optical camera. Further, the position detection unit 110 may have a configuration for rotating the metal pipe material 14 around the central axis L, and in that case, the rotating part 121 of the supply device 120 may not be used in order to rotate the metal pipe material 14 around the central axis L.

Next, the configuration of the supply device 120 will be described. The supply device 120 is for supplying the metal pipe material 14 to the forming apparatus 10. The supply device 120 includes the rotating part 121 and a transport part 122. The rotating part 121 includes, for example, two rollers disposed parallel to each other at the same height and at an interval smaller than the diameter of the metal pipe material 14. At least one of the two rollers configuring the rotating part 121 is rotationally driven by a motor. In this way, the rollers are rotationally driven in a state where the metal pipe material 14 is placed on the two rollers configuring the rotating part 121, and thus the metal pipe material 14 is rotated around the central axis L.

The transport part 122 is capable of gripping the metal pipe material 14 and capable of transporting the gripped metal pipe material 14 to the forming apparatus 10. The transport part 122 is, for example, a robot arm in which a gripping part for gripping the metal pipe material 14 is provided at a tip portion of the arm (refer to FIG. 1). The transport part 122 can move the gripping part up and down, horizontally, and the like in a state where the metal pipe material 14 is gripped by the gripping part.

Next, the configuration of the unloading device 130 will be described. The unloading device 130 unloads the metal pipe 90 (refer to FIG. 10) formed from the metal pipe material 14 by the forming apparatus 10, from the forming apparatus 10. The unloading device 130 has the same configuration as the transport part 122 of the supply device 120. The unloading device 130 is capable of gripping the metal pipe 90 and capable of unloading the gripped metal pipe 90 from the forming apparatus 10. The unloading device 130 is, for example, a robot arm in which a gripping part for gripping the metal pipe 90 is provided at a tip portion of the arm. The unloading device 130 can move the gripping part up and down, horizontally, and the like in a state where the metal pipe 90 is gripped by the gripping part.

Next, the configuration of the control device 140 will be described. The control device 140 controls the operations of the position detection unit 110, the supply device 120, and the unloading device 130, as shown in FIGS. 1 and 4. The control device 140 includes a storage unit 141 and a supply device control unit 142.

Figure 7:
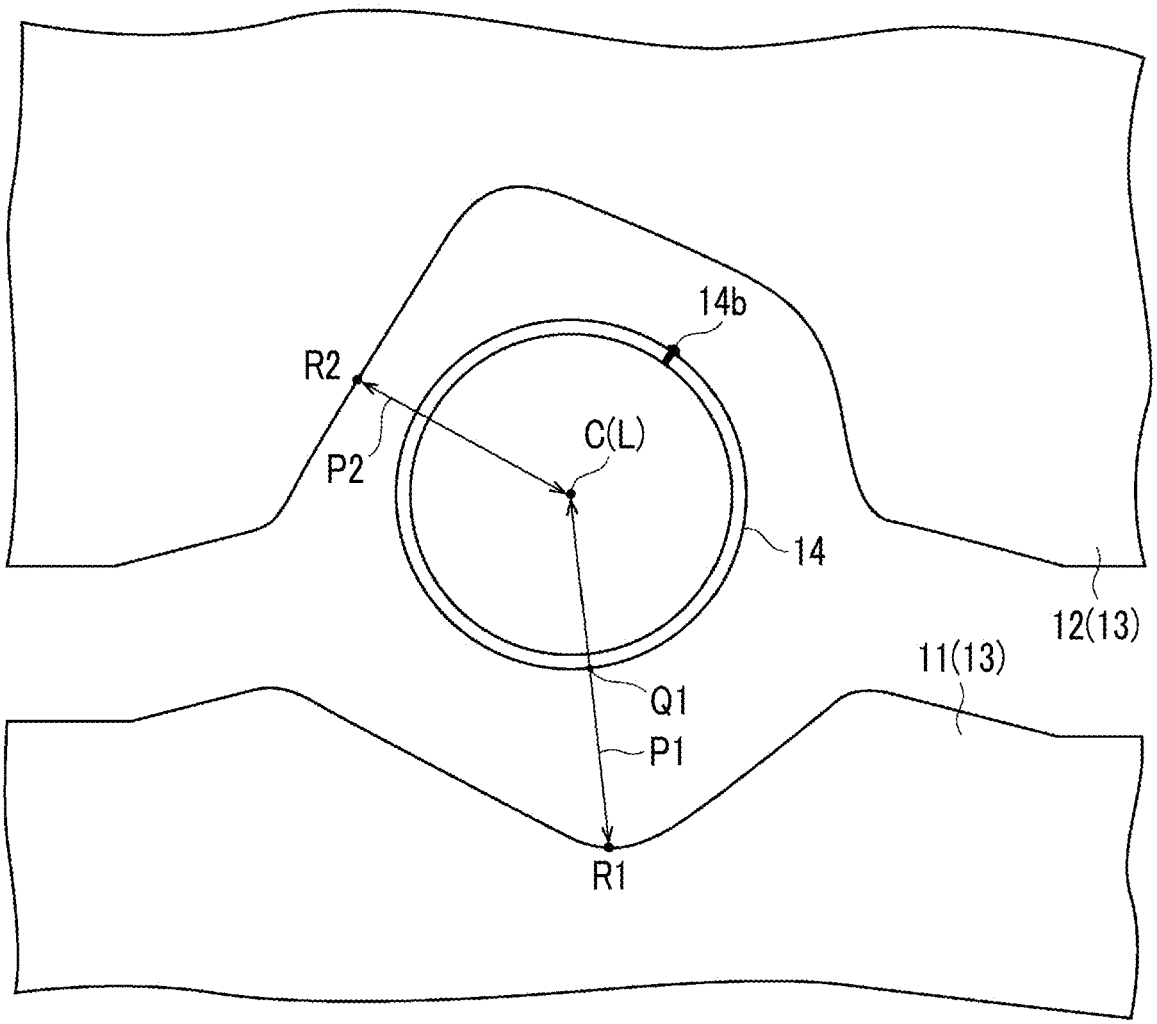
FIG. 7 is a diagram for describing a longest position and a shortest position.

The storage unit 141 stores information on a longest position R1 that is a position at which the distance from the center C of the metal pipe material 14 is the longest, on the surface of the blow forming die 13, in a case of being viewed from the extension direction D of the metal pipe material 14 in a state where the metal pipe material 14 is disposed between the set of blow forming dies 13 (refer to FIG. 7). The longest position R1 is a position at which the distance from the center C of the metal pipe material 14 is the longest, on the surface of the blow forming die 13, in a space which is formed by the cavity 16 of the lower die 11 and the cavity 24 of the upper die 12 of the blow forming dies 13 in a state where the metal pipe material 14 is disposed between the set of blow forming dies 13 when supplying the high-pressure gas into the metal pipe material 14. Further, the information on the longest position R1 may be, for example, the position coordinates of the longest position R1, or may be an angle at which the longest position R1 is located with respect to a straight line (for example, a straight line extending in the horizontal direction) passing through the center C of the metal pipe material 14, in a case of being viewed from the extension direction D of the metal pipe material 14 in a state where the metal pipe material 14 is disposed between the set of blow forming dies 13.

The supply device control unit (control unit) 142 controls, based on the information on the longest position R1 stored in the storage unit 141, the supply of the metal pipe material 14 to the forming apparatus 10 by the supply device 120 such that the welded portion 14*b* is not located on a straight line P1 connecting the longest position R1 and the center C of the metal pipe material 14 in a case of being viewed from the extension direction D of the metal pipe material 14 in a state where the metal pipe material 14 is disposed between the set of blow forming dies 13.

More specifically, the supply device control unit 142 controls the operation of the rotating part 121 so as to adjust the direction in which the welded portion 14*b* is located with respect to the center C of the metal pipe material 14 in a case of being viewed from the extension direction D of the metal pipe material 14, by rotating the metal pipe material 14 around the central axis L by the rotating part 121, when the metal pipe material 14 is supplied to the forming apparatus 10 by the supply device 120. Further, the supply device control unit 142 controls the operation of the transport part 122 so as to grip and transport the metal pipe material 14 to the forming apparatus 10 by the transport part 122.

Method of Forming Metal Pipe by Forming System

Figure 8:
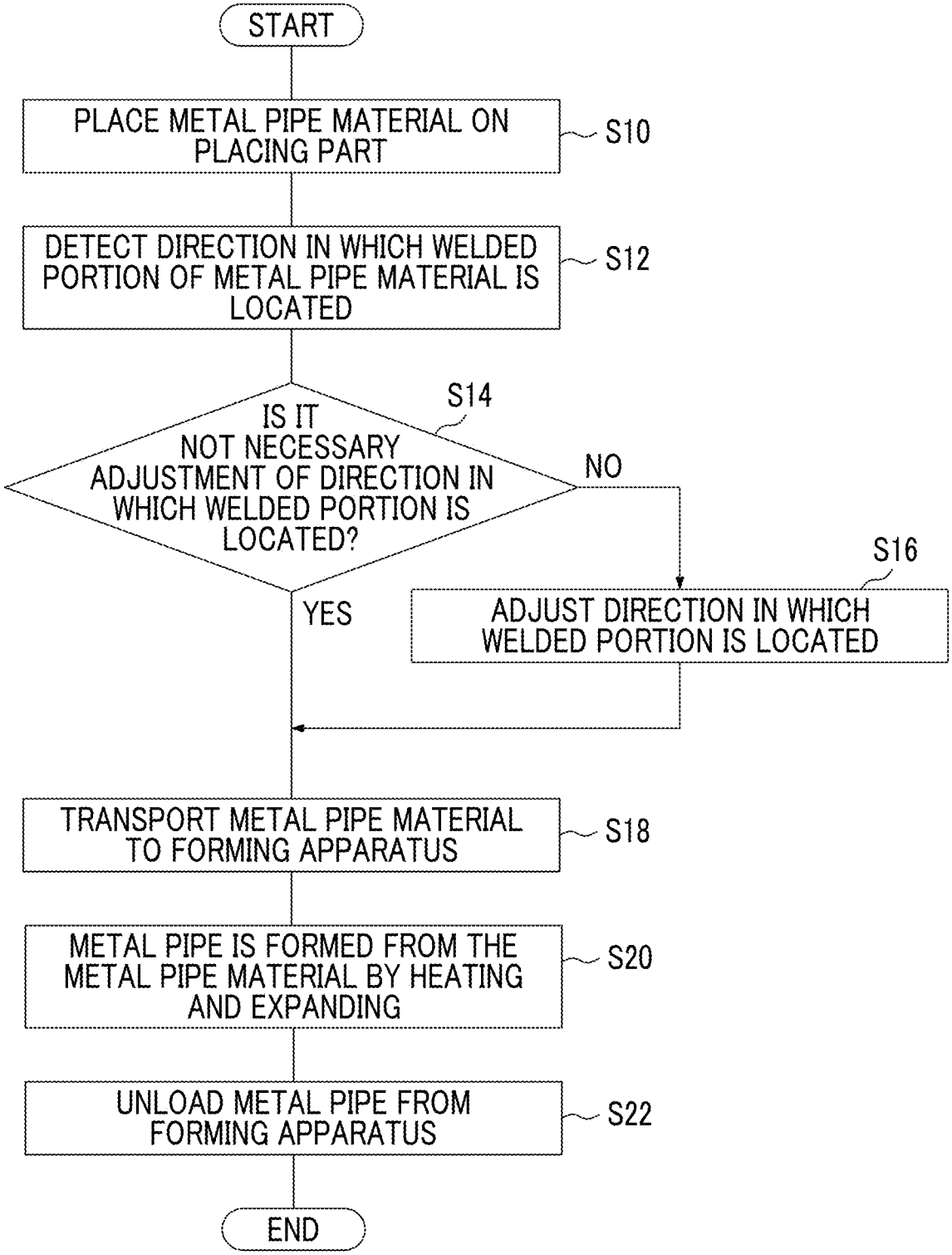
FIG. 8 is a flowchart showing a forming method.

Next, a method of forming the metal pipe 90 by using the forming system 1 of this embodiment will be described. FIG. 8 is a flowchart showing the forming method.

As shown in FIG. 8, first, in Step S10, the metal pipe material 14 is placed on a placing part. In this embodiment, the rotating part 121 of the supply device 120 is also used as the placing part. A configuration (for example, a shelf, a pallet, or the like disposed at a predetermined position) separate from the rotating part 121 of the supply device 120 may be used as the placing part. Thereafter, the routine proceeds to Step S12.

In Step S12, the control device 140 controls the operations of the rotating part 121 of the supply device 120 and the position detection unit 110 to detect the direction in which the welded portion 14*b* of the metal pipe material 14 placed on the placing part is located. More specifically, the control device 140 acquires imaging data of the outer peripheral surface of the metal pipe material 14 photographed by the optical means 111 while the metal pipe material 14 is rotated around the central axis L by the rotating part 121 of the supply device 120. The imaging data acquired by the optical means 111 is output to the welding position determination unit 112. The welding position determination unit 112 performs image processing on the input imaging data to detect the position of the welded portion 14*b* on the outer peripheral surface of the metal pipe material 14, and outputs the detected position to the control device 140. Thereafter, the control device 140 proceeds to Step S14.

In Step S14, the control device 140 determines whether or not the adjustment of the direction in which the welded portion 14*b* is located with respect to the center C of the metal pipe material 14 is unnecessary. More specifically, the storage unit 141 of the control device 140 stores the information on the longest position R1 that is a position at which the distance from the center C of the metal pipe material 14 is the longest, on the surface of the blow forming die 13, in a case of being viewed from the extension direction D of the metal pipe material 14 in a state where the metal pipe material 14 is disposed between the set of blow forming dies 13. Then, when the welded portion 14*b* of the metal pipe material 14 is not located on the straight line P1 connecting the longest position R1 and the center C of the metal pipe material 14 in a case of being viewed from the extension direction D of the metal pipe material 14 in a state where the metal pipe material 14 is disposed between the set of blow forming dies 13, the control device 140 determines that the adjustment of the direction in which the welded portion 14*b* is located with respect to the center C of the metal pipe material 14 is unnecessary. In a case where the control device 140 determines that the adjustment is unnecessary (Step S14: YES), the routine proceeds to Step S18. On the other hand, in a case where the control device 140 does not determine that the adjustment is unnecessary (Step S14: NO), the routine proceeds to Step S16.

In Step S16, the control device 140 controls the operation of the rotating part 121 of the supply device 120 to rotate the metal pipe material 14 around the central axis L. More specifically, the supply device control unit 142 of the control device 140 controls the operation of the rotating part 121 of the supply device 120, based on the information on the longest position R1 stored in the storage unit 141, thereby rotating the metal pipe material 14 around the central axis L such that the welded portion 14*b* of the metal pipe material 14 is not located on the straight line P1 connecting the longest position R1 and the center C of the metal pipe material 14 in a case of being viewed from the extension direction D of the metal pipe material 14 in a state where the metal pipe material 14 is disposed between the set of blow forming dies 13. Then, the control device 140 stops the rotation of the metal pipe material 14 in a state where the adjustment of the direction in which the welded portion 14*b* is located with respect to the center C of the metal pipe material 14 becomes unnecessary. Thereafter, the routine proceeds to Step S18.

In Step S18, the control device 140 controls the operation of the transport part 122 of the supply device 120 to cause the transport part 122 to grip the metal pipe material 14 and transport the griped metal pipe material 14 to the forming apparatus 10. The metal pipe material 14 is transported to the forming apparatus 10 and enters a state where it is placed between the set of blow forming dies 13. Thereafter, the routine proceeds to Step S20.

In Step S20, the metal pipe material 14 is heated by the heating and expanding part 103 of the forming apparatus 10, and a gas is supplied into the metal pipe material 14 to expand the metal pipe material 14. In this way, the metal pipe 90 is formed from the metal pipe material 14 in the blow forming dies 13. At this time, when the heated metal pipe material 14 expands, the welded portion 14*b* of the metal pipe material 14 comes into contact with the surface of the blow forming die 13 prior to a portion Q1 (refer to FIG. 7) which is located on the straight line P1 connecting the longest position R1 and the center C of the metal pipe material 14, and is cooled due to heat conduction. Thereafter, the routine proceeds to Step S22.

In Step S22, the control device 140 controls the operation of the unloading device 130 to grip the metal pipe 90 in the forming apparatus 10 and unload the gripped metal pipe 90 from the forming apparatus 10. By the above, the forming of the metal pipe 90 by the forming system 1 of this embodiment is ended.

Operation and Effects of Forming System

As described above, in the forming system 1 and the method of forming the metal pipe 90 by the forming system 1, when the heated metal pipe material 14 expands, the welded portion 14*b* of the metal pipe material 14 comes into contact with the surface of the blow forming die 13 prior to the portion Q1 which is located on the straight line P1 connecting the longest position R1 and the center C of the metal pipe material 14. Here, if the heated metal pipe material 14 expands and comes into contact with the surface of the blow forming die 13, the portion which is in contact with the blow forming die 13 is cooled due to heat conduction, and thus the deformation resistance of the portion increases. Therefore, in the forming system 1 and the method of forming the metal pipe 90 by the forming system 1, at the time of the forming of the metal pipe 90, the welded portion 14*b* comes into contact with the blow forming die 13 at an earlier timing than the portion Q1 on the straight line P1, and thus the deformation resistance of the welded portion 14*b* increases at an early timing, and therefore, it is possible to suppress the plate thickness of the welded portion 14*b* becoming particularly thin locally. Accordingly, it is possible to suppress the breakage of the metal pipe material 14 starting from the welded portion 14*b* at the time of the forming of the metal pipe 90.

Further, in the forming system 1, the supply device 120 includes the rotating part 121 capable of rotating the metal pipe material 14 around the central axis L, and the transport part 122 capable of gripping the metal pipe material 14 and capable of transporting the gripped metal pipe material 14 to the forming apparatus 10, and the supply device control unit 142 controls the operation of the rotating part 121 so as to adjust the direction in which the welded portion 14*b* is located with respect to the center C of the metal pipe material 14 in a case of being viewed from the extension direction D of the metal pipe material 14, by rotating the metal pipe material 14 around the central axis L by the rotating part 121, when supplying the metal pipe material 14 to the forming apparatus 10 by the supply device 120, and controls the operation of the transport part 122 so as to grip and transport the metal pipe material 14 to the forming apparatus 10 by the transport part 122. For this reason, the direction in which the welded portion 14*b* is located with respect to the center C of the metal pipe material 14 can be adjusted by the rotating part 121, and the metal pipe material 14 can be transported to the forming apparatus 10 by the transport part 122. Accordingly, the operation and effects of this embodiment can be suitably exhibited.

Further, in the forming system 1, the position detection unit 110 is provided which detects the direction in which the welded portion 14*b* is located with respect to the center C of the metal pipe material 14 in a case of being viewed from the extension direction D of the metal pipe material 14, before the metal pipe material 14 is supplied to the forming apparatus 10 by the supply device 120. For this reason, the operation and effects of this embodiment can be suitably exhibited.

Another Embodiment

Figure 9:
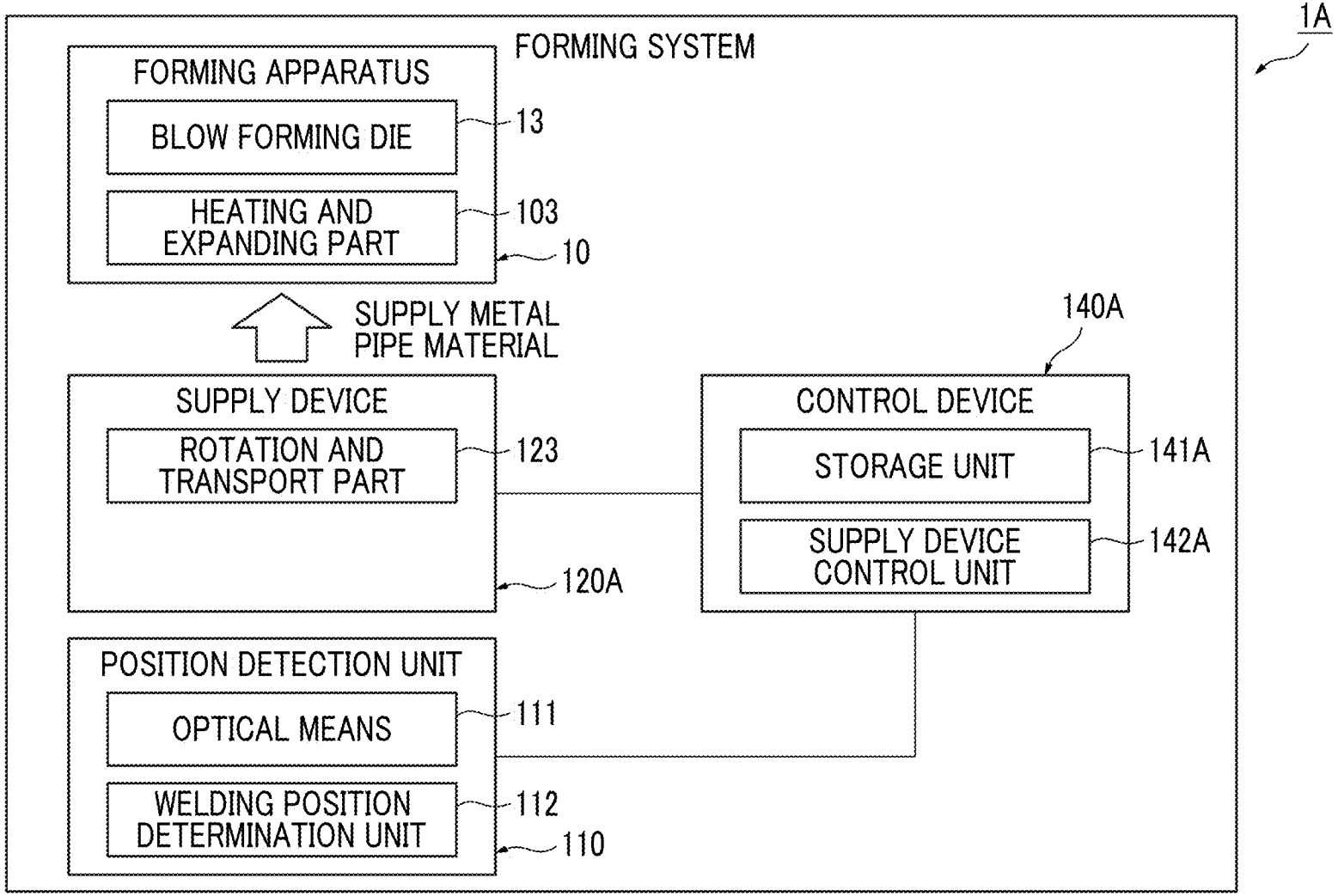
FIG. 9 is a functional block diagram showing a forming system of another embodiment.

As shown in FIG. 9, a forming system 1A of another embodiment is mainly different from the forming system 1 of one embodiment described above and the method of forming the metal pipe 90 by the forming system 1 in terms of the configuration of a supply device 120A. That is, the supply device 120A has a rotation and transport part 123 composed of an articulated arm capable of gripping the metal pipe material 14 and rotating the gripped metal pipe material 14 around the central axis L and capable of transporting the metal pipe material 14 to the forming apparatus 10.

In the forming system 1A of another embodiment having such a configuration, a supply device control unit 142A controls the operation of the rotation and transport part 123 so as to adjust the direction in which the welded portion 14*b* is located with respect to the center C of the metal pipe material 14 in a case of being viewed from the extension direction D of the metal pipe material 14, by gripping the metal pipe material 14 and rotating the metal pipe material 14 around the central axis L by the rotation and transport part 123, and to transport the metal pipe material 14 to the forming apparatus 10, when the metal pipe material 14 is supplied to the forming apparatus 10 by the supply device 120A.

It goes without saying that also in the forming system 1A and the forming method of another embodiment, the same operation and effects as those in the forming system 1 and the forming method of one embodiment can be exhibited.

In addition, in the forming system 1A, the supply device 120A has the rotation and transport part 123 composed of an articulated arm capable of gripping the metal pipe material 14 and rotating the gripped metal pipe material 14 around the central axis L and capable of transporting the metal pipe material 14 to the forming apparatus 10, and the supply device control unit 142A controls the operation of the rotation and transport part 123 so as to adjust the direction in which the welded portion 14*b* is located with respect to the center C of the metal pipe material 14 in a case of being viewed from the extension direction D of the metal pipe material 14, by gripping the metal pipe material 14 and rotating the metal pipe material 14 around the central axis L by the rotation and transport part 123, and to transport the metal pipe material 14 to the forming apparatus 10, when the metal pipe material 14 is supplied to the forming apparatus 10 by the supply device 120A. For this reason, it is possible to transport the metal pipe material 14 to the forming apparatus 10 while adjusting the direction in which the welded portion 14*b* is located with respect to the center of the metal pipe material 14, by the rotation and transport part 123. Accordingly, it is possible to shorten the time required to supply the metal pipe material 14 to the forming apparatus 10 by the supply device 120A.

The embodiments of the present invention have been described above. However, the present invention is not limited to the embodiments described above.

For example, in the forming systems 1 and 1A, the control devices 140 and 140A may include the storage units 141 and 141A which store information on a shortest position R2 (refer to FIG. 7) that is a position at which the distance from the center C of the metal pipe material 14 is the shortest, on the surface of the blow forming die 13, in a case of being viewed from the extension direction D of the metal pipe material 14 in a state where the metal pipe material 14 is disposed between the set of blow forming dies 13, and the control devices 140 and 140A may include the supply device control units 142 and 142A which control, based on the information on the shortest position R2 stored in the storage units 141 and 141A, the supply of the metal pipe material 14 to the forming apparatus 10 by the supply devices 120 and 120A such that the welded portion 14*b* is located on a straight line P2 connecting the shortest position R2 and the center C of the metal pipe material 14 in a case of being viewed from the extension direction D of the metal pipe material 14 in a state where the metal pipe material 14 is disposed between the set of blow forming dies 13. The shortest position R2 is a position at which the distance from the center C of the metal pipe material 14 is the shortest, on the surface of the blow forming die 13, in the space which is formed by the cavity 16 of the lower die 11 and the cavity 24 of the upper die 12 of the blow forming dies 13, in a state where the metal pipe material 14 is disposed between the set of blow forming dies 13 when supplying the high-pressure gas into the metal pipe material 14. Further, the information on the shortest position R2 may be, for example, the position coordinates of the shortest position R2, or may be an angle at which the shortest position R2 is located with respect to a straight line (for example, a straight line extending in the horizontal direction) passing through the center C of the metal pipe material 14, in a case of being viewed from the extension direction D of the metal pipe material 14 in a state where the metal pipe material 14 is disposed between the set of blow forming dies 13.

Similarly, as the method of forming the metal pipe 90 by the forming system 1 or 1A, the metal pipe material 14 may be disposed between the set of blow forming dies 13 such that the welded portion 14*b* is located on the straight line P2 connecting the shortest position R2 which is a position at which the distance from the center C of the metal pipe material 14 is the shortest, on the surface of the blow forming die 13, and the center C of the metal pipe material 14, in a case of being viewed from the extension direction D of the metal pipe material 14 in a state where the metal pipe material 14 is disposed between the set of blow forming dies 13.

In the forming system 1A and the method of forming the metal pipe 90 by the forming system 1A, when the heated metal pipe material 14 expands, the welded portion 14*b* of the metal pipe material 14, which is located on the straight line P2 connecting the shortest position R2 and the center C of the metal pipe material 14, first comes into contact with the surface of the blow forming die 13. Here, if the heated metal pipe material 14 expands and comes into contact with the surface of the blow forming die 13, the portion which is in contact with the blow forming die 13 is cooled due to heat conduction, and thus the deformation resistance of the portion increases. Therefore, in the forming systems 1 and 1A and the methods of forming the metal pipe 90 by the forming systems 1 and 1A, at the time of the forming of the metal pipe 90, the welded portion 14*b* first comes into contact with the blow forming die 13, and thus the deformation resistance of the welded portion 14*b* first increases, and therefore, it is possible to suppress the plate thickness of the welded portion 14*b* becoming particularly thin locally. Accordingly, it is possible to particularly suppress the breakage of the metal pipe material 14 starting from the welded portion 14*b* at the time of the forming of the metal pipe 90.

Further, in the respective embodiments, the forming systems 1 and 1A may not be provided with the unloading device 130. In this case, the formed metal pipe 90 may be unloaded from the forming apparatus 10 by, for example, the supply device 120 or 120A. According to this, the system configuration can be simplified, and a space adjacent to the forming apparatus 10 can be widely secured, so that a die replacement carriage or the like can be easily disposed in the space.

EXAMPLE

Subsequently, an example of the forming system and the forming method will be described with reference to FIGS. 10, 11, and 12.

Figure 10:
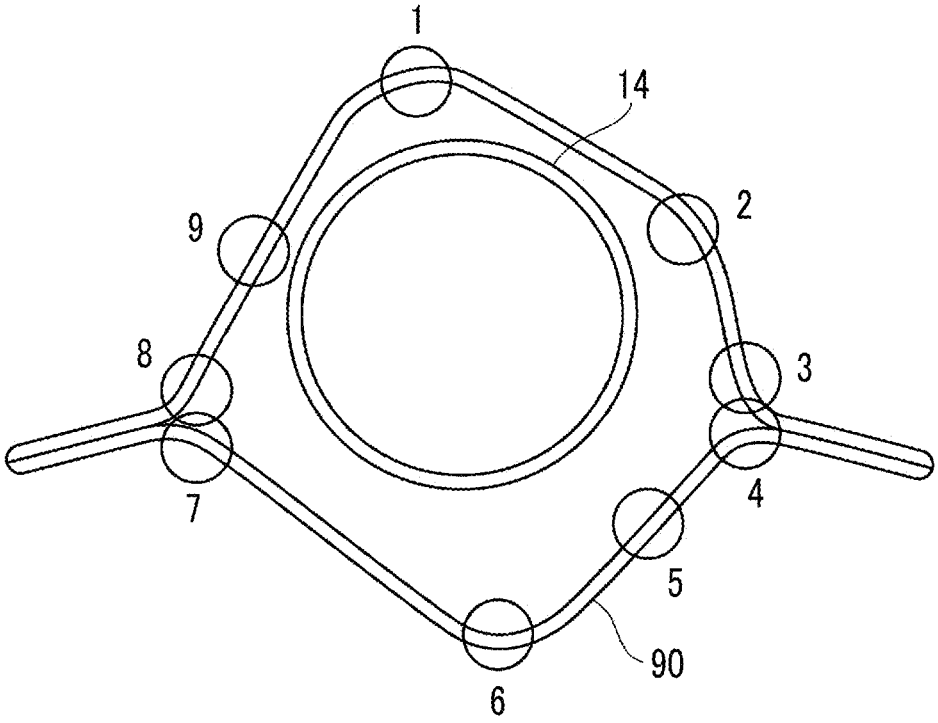
FIG. 10 is a diagram showing a metal pipe material and measurement positions of a plate thickness and a temperature of a metal pipe in an example.
Figure 11:
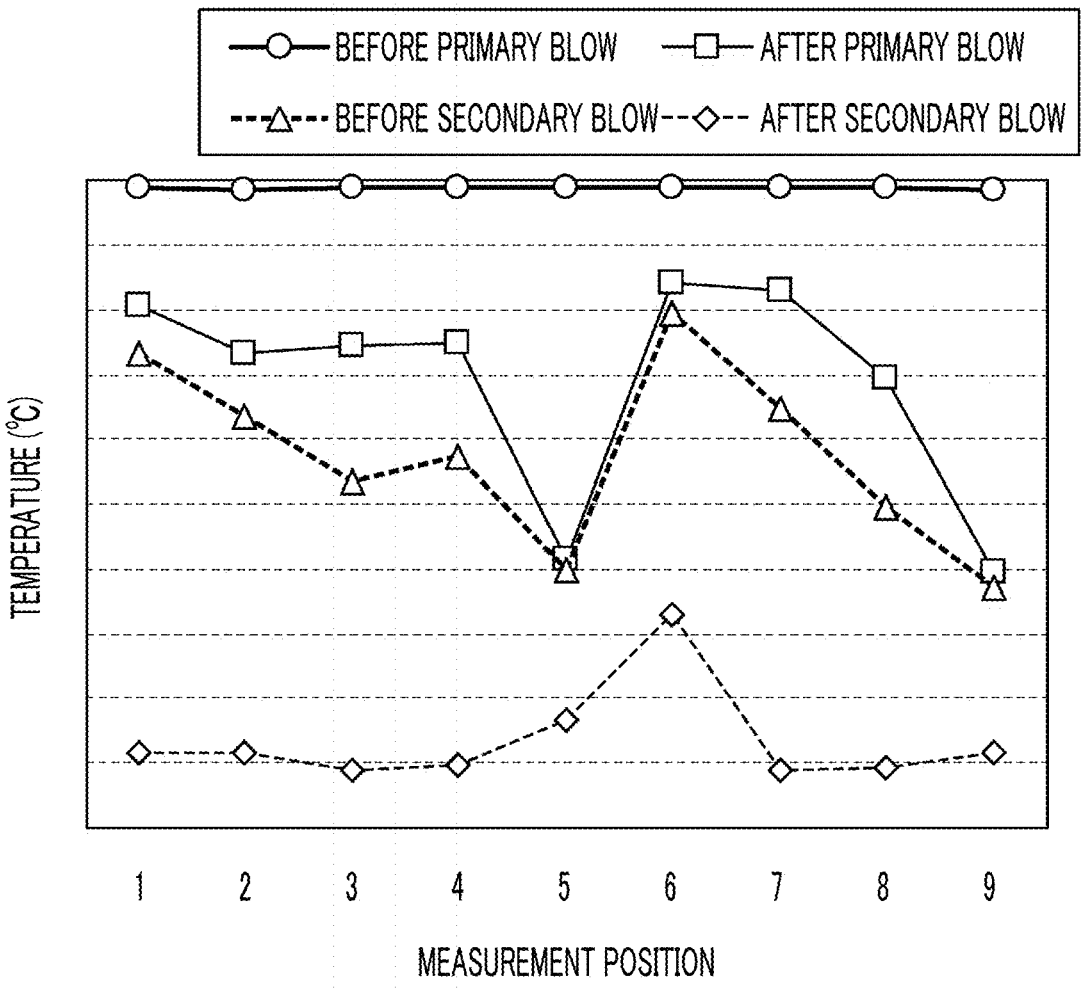
FIG. 11 is a graph of simulation results showing the temperatures of the metal pipe material and the metal pipe according to measurement timings, in a relationship with the measurement positions.
Figure 12:
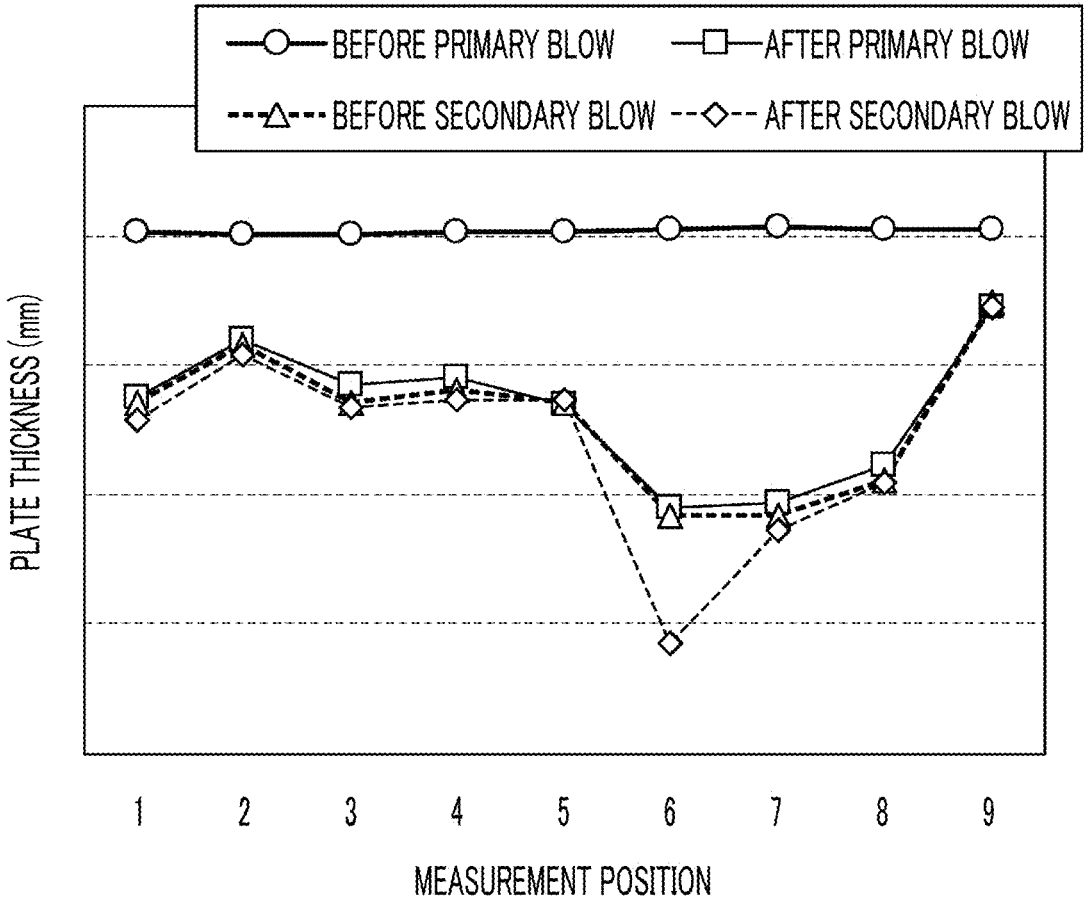
FIG. 12 is a graph of simulation results showing the plate thicknesses of the metal pipe material and the metal pipe according to measurement timings, in a relationship with the measurement positions.

FIG. 10 is a diagram showing the metal pipe material and measurement positions of the plate thickness and the temperature of the metal pipe in the example, and FIGS. 11 and 12 are graphs showing simulation results of the plate thickness and the temperatures of the metal pipe 90 at measurement positions 1 to 9 of FIG. 10 when forming the metal pipe 90 having the shape as shown in FIG. 10. As shown in FIG. 10, among the measurement positions 1 to 9, the measurement position 6 is the longest position R1, and the measurement position 9 is the shortest position R2. Further, in this example, the supply of the high-pressure gas having a relatively low pressure (primary blow) and the supply of the high-pressure gas having a relatively high pressure (secondary blow) into the metal pipe material 14 were assumed to be performed in this order. In FIGS. 11 and 12, the plate thickness or the temperature is shown to be divided into measurement timings before the primary blow, after the primary blow, before the secondary blow, and after the secondary blow. Here, before the primary blow refers to before the blow forming work on the metal pipe material 14 is started, and after the secondary blow refers to after the blow forming work on the metal pipe material 14 is completed and the metal pipe 90 is formed.

When forming the metal pipe 90, the set of blow forming dies 13 are closed to a halfway position in a state where the metal pipe material 14 is disposed between the set of blow forming dies 13. In this state, the primary blow is performed, and thus the metal pipe material 14 is brought into contact with the blow forming die 13 on the straight line P2 connecting the measurement position 9 which is the shortest position R2 and the center of the metal pipe material 14. Thereafter, the set of blow forming dies 13 is completely closed and the secondary blow is performed to complete the forming of the metal pipe 90.

At the measurement position 6 which is the longest position R1, the heated metal pipe material 14 comes into contact with the blow forming die 13 at a late timing, thereby being cooled, and thus the deformation resistance increases at the late timing. As a result, as shown in FIG. 11, the temperature of the metal pipe material 14 becomes excessively high at the measurement position 6, and as shown in FIG. 12, the plate thickness of the metal pipe material 14 becomes excessively thin at the measurement position 6.

On the other hand, at the measurement position 9 which is the shortest position R2, the heated metal pipe material 14 first comes into contact with the blow forming die 13, thereby being cooled, and thus the deformation resistance increases at an early timing. As a result, as shown in FIG. 11, the temperature of the metal pipe material 14 is moderately lowed at the measurement position 9, and as shown in FIG. 12, the plate thickness of the metal pipe material 14 becomes a moderate thickness at the measurement position 9. From the above, it has been confirmed that by the forming system 1 and the forming method, it is possible to suppress the plate thickness of the welded portion 14*b* becoming particularly thin locally at the time of the forming of the metal pipe 90.

It should be understood that the invention is not limited to the above-described embodiment, but may be modified into various forms on the basis of the spirit of the invention. Additionally, the modifications are included in the scope of the invention.

What is claimed is:

1. A forming system for forming a metal pipe including a pipe portion and a flange portion by heating and expanding a metal pipe material that comprises a plate material and a welded portion, wherein end portions of the plate material are welded to each other to form the welded portion, the forming system comprising:

a forming apparatus that comprises:

a set of dies configured to retain, when heating and expanding the metal pipe material, the metal pipe material, wherein one of the dies comprises a longest position on a surface of the one of the dies, and a heating and expanding part configured to supply a gas that is configured to deform the metal pipe material, after receiving the metal pipe material from a supply device and clamping the metal pipe material between the dies, to the metal pipe material;

a position detection unit that comprises:

a welding position determination unit configured to detect, before the supply device supplies the metal pipe material to the forming apparatus, a position of the welded portion, wherein the position detection unit is configured to output data that specifies the position of the welded portion; and a control device that is configured to:

receive, from the welding position determination unit, the data, and control, according to the data, the supply device to dispose the metal pipe material between the dies such that the position of the welded portion is not located on a straight line connecting a center of the metal pipe material and the longest position, wherein a distance between the center and the surface is the longest at the longest position.

2. The forming system according to claim 1, wherein the supply device is configured to supply the metal pipe material with the welded portion to the forming apparatus.

3. The forming system according to claim 1, wherein the welding position determination unit is configured to detect, before the dies retain the metal pipe material, the position of the welded portion.

4. The forming system according to claim 1, wherein the control device is configured to process, before the forming apparatus supplies the gas to the metal pipe material, the position of the welded portion in a manner that permits the control device to determine whether or not the welded portion is to be relocated.

5. The forming system according to claim 1, wherein the control device is configured to determine, before the metal pipe material is located between the dies, whether or not the position of the welded portion is located in the pipe portion of the metal pipe.

6. The forming system according to claim 1, wherein the control device is configured to determine, before the metal pipe material is between the dies, whether or not the position of the welded portion is located on the straight line.

7. The forming system according to claim 1, wherein the control device is configured to control, before the heating and expanding part supplies the gas to the metal pipe material, the supply device to dispose the metal pipe material between the dies.

8. The forming system according to claim 1, wherein the control device is configured to control, before the metal pipe material is located between the dies, the supply device to dispose the metal pipe material between the dies.

9. The forming system according to claim 1, wherein the supply device comprises:

a rotating part configured to reposition, when the control device determines that the position of the welded portion is located on the straight line, the welded portion with respect to the dies.

10. The forming system according to claim 9, wherein the rotating part is configured to reposition the welded portion with respect to the dies before the supply device supplies the metal pipe material to the forming apparatus.

11. The forming system according to claim 9, wherein the rotating part is configured to rotate the metal pipe material around a central axis.

12. The forming system according to claim 9, wherein the supply device further comprises:

a transport part configured to transport the metal pipe material to the forming apparatus.

13. The forming system according to claim 12, wherein the transport part is configured to grip the metal pipe material before transporting the metal pipe material to the forming apparatus.

14. The forming system according to claim 1, wherein the heating and expanding part is configured to supply, after the control device determines whether or not a repositioning of the welded portion with respect to the dies is necessary, the gas into the metal pipe material.

* * * * *